US005170941A

United States Patent [19]

Morita et al.

[11] Patent Number: 5,170,941

[45] Date of Patent: Dec. 15, 1992

[54] PREMIXING-TYPE SPRAY GUN

[75] Inventors: Nobuyoshi Morita; Hajime Iwata, both of Yokohama, Japan

[73] Assignee: Iwata Air Compressor Mfg. Co., Ltd., Tokyo, Japan

[21] Appl. No.: 869,882

[22] Filed: Apr. 14, 1992

Related U.S. Application Data

[63] Continuation of Ser. No. 510,077, Apr. 17, 1990, abandoned.

[30] Foreign Application Priority Data

Apr. 20, 1989 [JP] Japan ..... 1-100539[U]
Aug. 11, 1989 [JP] Japan ..... 1-95278[U]

[51] Int. Cl.[5] ..... B05B 7/04; B05B 7/12

[52] U.S. Cl. ..... 239/416.4; 239/290; 239/433; 239/526; 239/601

[58] Field of Search ..... 239/290, 291, 292, 294, 239/296, 299, 300, 8, 11, 416.4, 416.5, 417.3, 419, 427, 434.5, 526, 601

[56] References Cited

U.S. PATENT DOCUMENTS

| | | | |
|---|---|---|---|
| 1,369,520 | 2/1921 | Day | 239/11 |
| 2,172,193 | 9/1939 | Downs | 239/416.4 |
| 2,214,035 | 9/1940 | Tracy | 239/601 |
| 2,297,497 | 9/1942 | Popoff | 239/8 |
| 2,475,000 | 7/1949 | Beach, Jr. | 239/300 |
| 4,219,157 | 8/1980 | Binoche | 239/299 |
| 4,273,287 | 6/1981 | Huber | 239/299 |
| 4,386,739 | 6/1983 | Kwok | 239/296 |
| 4,817,872 | 4/1989 | Mattson | 239/300 |

FOREIGN PATENT DOCUMENTS

| | | | |
|---|---|---|---|
| 142410 | 1/1950 | Australia | 239/417.3 |
| 247998 | 11/1965 | Fed. Rep. of Germany | 239/295 |
| 889602 | 2/1962 | United Kingdom | 239/417.3 |

*Primary Examiner*—Andres Kashnikow
*Assistant Examiner*—Christopher C. Trainor
*Attorney, Agent, or Firm*—Wenderoth, Lind & Ponack

[57] ABSTRACT

The present invention is a premixing-type spray gun which mixes a paint and compressed air inside the atomizing head and blows out the mixture as atomized from the spray hole. The inner and outer surfaces of the center hole in the atomizing head of the spray gun body are conical, and there is formed at the center of the cap having a nearly concentrical thickness at a lip-like aperture by providing a generally V-shaped recess from outside. Paint can be sprayed under a pressue of less than 1 kgf/cm$^2$ with which the paint is less scattered, and the sprayed particle sizes can be made fine as with the conventional air spray guns.

5 Claims, 4 Drawing Sheets

PREMIXING-TYPE SPRAY GUN

This application is a continuation of Ser. No. 510,077, filed Apr. 17, 1990, now abandoned.

BACKGROUND OF THE INVENTION

1. Field of the Invention

The present invention relates to a premixing-type spray gun which mixes paint and compressed air inside the atomizing head and blows out the mixture as atomized spray from the spray hole, and more particularly to a spray gun which uses a low air pressure of less than 1 kgf/cm$^2$.

2. Description of the Prior Art

Generally, many of the spray guns called an "air spray gun" are used for spraying paint. The air spray guns using compressed air as atomizing means are generally classified into premixing and non-premixing types.

With the premixing-type spray gun, paint and compressed air are mixed inside the atomizing head thereof, and the mixture is blown out as atomized spray from the spray hole. On the other hand, the non-premixing spray gun is so constructed that the paint blow-out hole and air blow-out hole are opened out in the outer surfaces of the atomizing head and a liquid-state paint is blown out from the paint nozzle and is atomized and dispersed with another paint flow blown out as diffused mixture around the liquid-state paint flow. These spray guns utilize a suction power, that is, a negative pressure, of the compressed air for blowing out the paint. In other words, the paint is blown out under a pressure of several kgf/cm$^2$ by means of a supply unit such as a pump and the paint will not be atomized just by the paint blow-out alone. The compressed air is used as energy for atomizing the paint. Usually an air pressure of about 2 to 5 kgf/cm$^2$ is used for this purpose. In the premixing-type spray gun shown by way of example in FIGS. 6A and 6B, a paint blow-out hole e opens through an air cap b, and a nozzle hole d in nozzle 3 is opened and closed by a needle valve c to control the blow-out of paint. Under the action of compressed air supplied around the nozzle hole d, the paint is dispersed inside the air cap b and sprayed out from a spray hole e opening out of the center of the air cap b and which is opposite the nozzle hole d.

Generally, the spray hole e is circular, but the shape of the nozzle can be elliptical or rectangular according to the spraying conditions. Because the spray particle size is larger than that with the non-premixing-type spray guns, the spray guns of this premixing type are used as special spray guns for spraying wall paint on a building, adhesive, etc. where the sprayed surface may not be smooth.

On the other hand, the non-premixing-type spray guns used as a so-called "spray gun" and suitably usable with a variety of paints and spraying conditions have been proposed. The common features of these well-known spray guns lie in that they have a blow-out hole in the paint nozzle at the center thereof, the blow-out hole being directed outwardly of the atomizing head. There are provided around this blow-out hole circular air orifices so that compressed air is blown out surrounding a paint flow blown out from the blow-out hole. Namely, the paint and compressed air are blown out separately and mixed and atomized in front of the atomizing head. Normally, many of the spray guns of this type have a pair of lateral air orifices across the atomized paint, which blow compressed air onto the atomized flow from both sides thereof, thereby adjusting the shape of the spray pattern.

Therefore, the spray flow blown out as a circular pattern can have the shape adjusted so as to be flattened by changing the blow-out pressure at the lateral air orifices or the blow-out amount. Since the paint and air are mixed outside of the spray gun, the sprayed paint particle size can be made smaller as the compressed air amount (pressure) is increased.

In conventional spray guns, however, atomization is done with air, which will result in the problem of paint scattering. This paint scattering causes considerable problems in spray efficiency, environmental sanitation or public health, etc. More particularly, the paint will be scattered even more with a higher air blowing pressure. Thus, it is desired to spray the paint with an air pressure as low as possible. For a better finish of the paint-sprayed surface, however, the particle size of atomized paint has to be smaller, which requires a pulverization of paint under the action of highly compressed air. These two factors are quite opposite to each other. With the majority of conventional spray guns, paint spraying is done with much paint scattering and low spraying efficiency as well as at the cost of environmental security.

However, the effective utilization of resources and the security of the environment will be increasingly important for human beings, and so a spray gun which produces atomization under lower pressure will be necessary.

The atomizing medium for paint is not limited to air. For example, it is already known to atomize paint by blowing it out under a high pressure from the nozzle into the atmosphere so that the paint will collide with the latter. However, industrial spray guns of this type require a paint pressure as high as 100 kgf/cm$^2$. For this purpose, a special pump is required, and also a danger may possibly exist. To avoid such problems, a spray gun is also used in which the paint pressure is lowered to several ten kgf/cm$^2$ and compressed air is used for the reduced pressure. However, the problems still are not eliminated, and the air pressure is not sufficiently low. That is to say, no satisfactory spray gun has yet been proposed.

SUMMARY OF THE INVENTION

An object of the present invention is to overcome the above-described drawbacks of conventional techniques by providing a premixing-type spray gun which uses a spraying pressure of less an 1 kgf/cm$^2$ and can provide a sprayed paint particle size equivalent to that with a conventional spray gun without spoiling the finish of the paint-sprayed surface.

According to one aspect of the present invention, there is provided a premixing-type spray gun which mixes a compressed air flow into paint blown out from a nozzle open out of a cap from around the paint and then sprays out the mixture from the central hole of the cap, the inner wall of the center hole being conical or nearly conical, the outer surface also being conical or nearly conical, and a generally lip-like aperture being formed at the center of the cap having nearly the same thickness by providing a nearly V-shaped recess extending inwardly from outside.

According to another aspect of the present invention, there is provided a premixing-type spray gun wherein the aperture in the cap is formed like a lip, the aperture of an inner paint nozzle being divergent to mix air from the end thereof.

According to yet another aspect of the present invention, there is provided a premixing-type spray gun wherein compressed air is blown out from a tapered conical slit formed along the outer circumference of a spray hole toward the aperture in the spray hole, thereby blowing the compressed air as a circular air flow, to prevent paint from adhering to the outlet of the spray hole during spraying and blown-back paint adhering to the conical outer surface around the spray hole and being separated by being peeled off during spraying, resulting in contamination of the surface to be sprayed, deformation of the air hole, poor pulverization and patterning of the paint.

Because of the above-described construction, the paint blown out from the nozzle is mixed and dispersed with the compressed air supplied from around the paint flow, then directed toward the spray hole through which it is blown out in a flat pattern from a flat aperture. Since the inner and outer surfaces of the aperture have nearly the same shape and are uniformly thin, the paint particles are dispersed due to the edge effect, while the surrounding air is absorbed along the conical outer surface under the action of the mixture flow, and thus the paint dispersion is more accelerated at the aperture end. Hence, the paint can be satisfactorily atomized even under a pressure of less than 1 $kgf/cm^2$.

Further, since the aperture end of the nozzle is divergent, the paint blown out from the seat has a much larger path sectional area when blown out from the nozzle aperture end. So it is easily dispersed and has an extremely large area of contact with the surrounding compressed air, and thus sufficient mixing can be attained, thereby permitting a fine atomization of the paint. As a result, the atomized paint is blown out from the blow-out hole in the cap. Since the outside diameter of the nozzle is slightly larger than the diameter of the path communicating with the spray hole, the paint-air mixture to be sprayed out can be atomized to a maximum extent. Namely, when the outer diameter of the nozzle is smaller than the diameter of the path, the paint is sprayed out without being mixed sufficiently and without sufficient contact with the compressed air, while if the outer diameter of the nozzle is too much larger than the diameter of the path, the paint particles will be reunited with each other in the path with the result that the effect of premixing and preatomizing will be lost.

Furthermore, the paint mixed inside the atomizing head of the spray gun and blown out as atomized from the spray hole is adjusted to a predetermined spray pattern under the action of compressed air blown from the lateral air orifice outside the cap, and directed toward the object to be spray-painted, while a mass of the paint deflected up to the aperture end with the compressed air blown from a tapered conical slit formed in the outer circumference of the spray hole is blown back to the latter. In this case, the particles of paint inside the air flow for formation of the above-described pattern and blown back to the conical outer surface about the spray hole are shifted to a spray flow from the spray hole under the action of the circular air flow developed by the collision of compressed air flow blown out from about the spray hole and the pattern forming air flow, and thus the blown-back paint particles are prevented from adhering to the nozzle.

These and other objects and advantages of the present invention will be better understood from the ensuing description of the embodiments of the spray gun according to the present invention with reference to the drawings.

DETAILED EXPLANATION OF THE PREFERRED EMBODIMENTS

Figure 1:
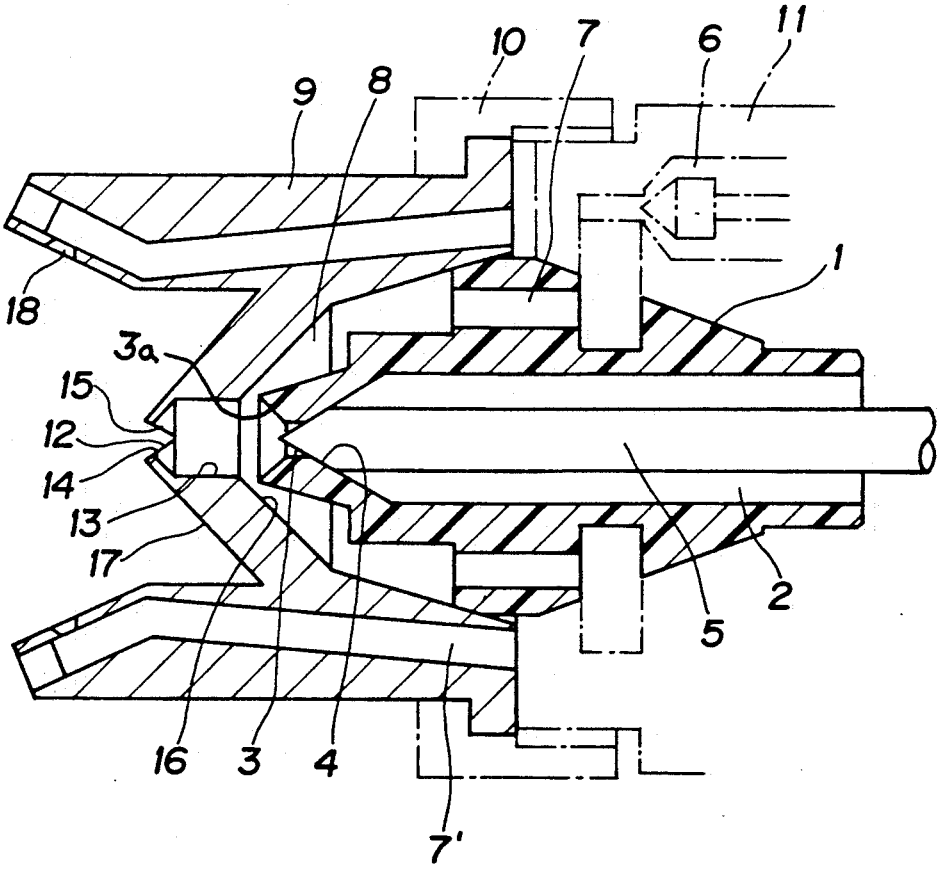
FIG. 1 is a sectional view, enlarged in scale, of the atomizing head which is an essential part of the spray gun according to the present invention.

FIG. 1 is a sectional view showing the atomizing head, the essential part of the present invention. This atomizing head is mounted on a well-known spray gun, and paint and compressed air are supplied from their respective paths. The reference numeral 1 indicates a paint nozzle made of a relatively rigid steel, but since water-soluble paint is presently widely used, many such nozzles are made of stainless steel. The paint nozzle 1 has formed inside the center thereof a paint path 2 which has a blow-out hole 3 formed at the end thereof. The blow-out hole 3 is provided inside thereof with a seat 4 which a needle valve 5 abuts. The outer end portion of the blow-out hole 3 has an outwardly diverging outer end portion 3*a*. This needle valve 5 controls the blowing out of the paint. When the nozzle 1 is mounted on a spray gun body 11, there is formed between the outside of the nozzle and the spray gun body, an air path 7 which communicates with an air supply path 6. The nozzle 1 protruding at the front end of the spray gun body 11 is covered with an air cap 9 having a conical outwardly diverging inner surface 6 extending past said blow-out hole 3 and defining with the nozzle an air path gap 8, and fixed and integrally joined with the spray gun body 11 by means of a cover 10.

The nozzle 1 is accommodated inside the air cap 9 as described above, and has formed at the central end thereof a spray hole 12 opposite the blow-out hole 3. The spray hole 12 has a conical inner surface 14 contiguous to a cylindrical inner surface 13. A mouth forming opening, here shown as a V-shaped opening 15, is formed from the outside toward the center of the conical surface 14, thereby forming the spray hole with a generally mouth-like opening. The conical inner surface 14 may instead have, for example, a cannonball shape or a spherical shape. Also, the V-shaped recess 15 may instead have a trapezoidal shape. The diameter of the outer end portion 3*a* is slightly larger than the diameter of cylindrical inner surface 13.

The compressed air led through the air path 7 flows to the central portion from the air path gap 8 formed between the cap inner surface 16 and the outer diameter of the nozzle around the blow-out hole 3 in the nozzle 1, and mixed with the blown-out paint at the end of the blow-out hole 3. A mixture thus produced is dispersed as atomized and sprayed out from the spray hole 12. The spray hole 12 has a lip-like shape as mentioned above, and so the spray pattern is sprayed in a nearly elliptical pattern on an object to be painted.

In this case, the outer surface of the air cap 9 is formed with a conical outer surface 17 similar to the conical inner surface 14 and defining an annular edge across which said recess 15 extends, so that surrounding air is easily sucked along the conical outer surface 17 under the action of the spray flow and the surrounding air will flow into the open end of the spray hole 12.

The opening in the spray hole 12 has along the entire circumference thereof nearly the same thickness between the inner and outer conical surfaces, so the paint-air mixture can be uniformly dispersed. For improving this effect, the thickness may be smaller. It is about 0.6 mm in the embodiment shown. This thickness should preferably be less than 1 mm. Namely, the thickness desired is small, but it depends upon the desired strength and durability.

In this embodiment, air orifices 18 are provided around the spray hole 12. The orifices 18 communicate with an air path 7' formed in the air cap 19 branched from the air path 6 in the air gun body 11 similarly to those in other non-premixing-type spray guns, so that adjustment compressed air comes into contact with the blown-out paint particles to adjust the spray pattern.

Figure 2:
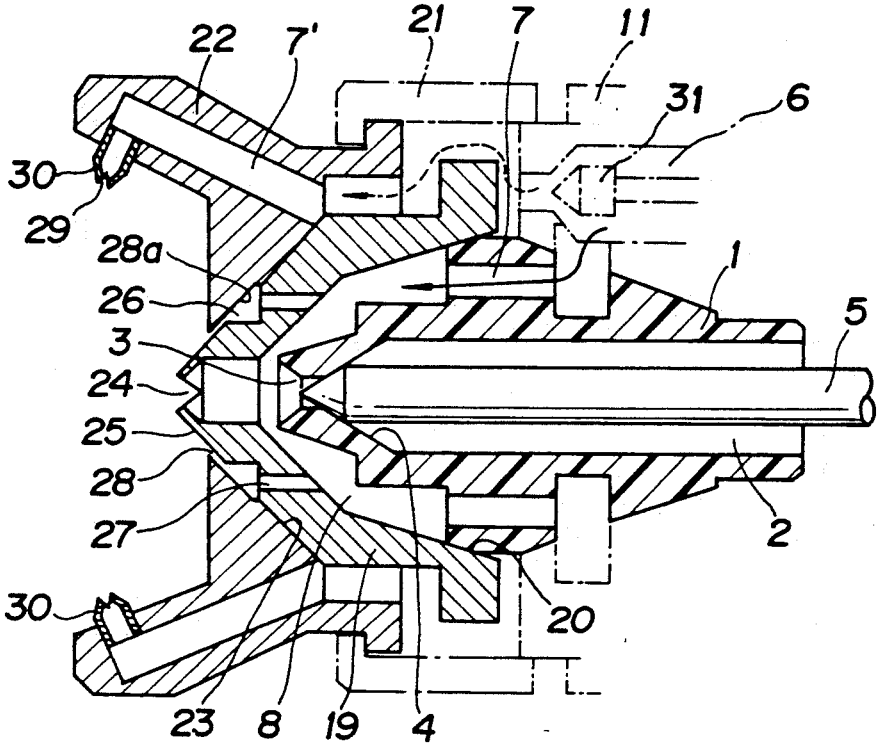
FIG. 2 is a sectional view, enlarged in scale, of the atomizing head according to another embodiment of the present invention.

FIG. 2 shows the atomizing head according to another embodiment of the present invention. As shown, a paint path 2 is formed at the inner center of the nozzle 1, and a blow-out hole 3 is formed at the end of the path 2. Also, a seat 4 is provided inside the blow-out hole 3. As in the atomizing head shown in FIG. 1, an air path 7 communicating with an air path 6 is formed along the outer surface of the nozzle 1 when the latter is fixed to the spray gun body 11.

Furthermore, the nozzle 1 has fitted on the front surface thereof a tapered end portion 20 of a tip cap 19 and which defines with the nozzle an air path gap 8. The nozzle 1 and tip cap 19 are disposed concentrically to each other, and the tip cap 19 is fitted at the end thereof and pressed by an inner surface 23 of the air cap 22 fitted with a cover 21 disposed on the spray gun body 11.

Figure 3:
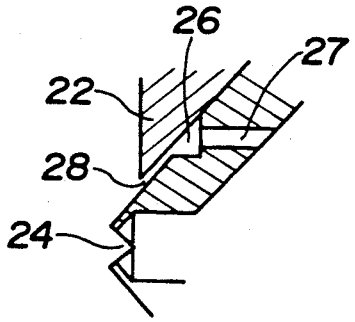
FIG. 3 is a sectional view, enlarged in scale, showing another construction of the slit.

In this case, the tip cap 19 has formed at the center end thereof a spray hole 24 having a lip-like shape, and also has provided on the outer surface thereof a conical tapered surface 25. A circumferential recess 26 is formed at an intermediate portion of the conical tapered surface 25, and a plurality of air orifices 27 (two are shown in the drawing for the simplicity of the illustration) communicating with the air path gap 8 are formed in the recess 26 and regularly spaced along the circumference as much as possible. The lip-like spray hole 24 of the tip cap 19 is appropriately protruded from the central opening in the air cap 22, and a counterface is formed at **28*a* on the inner tapered surface 23 so as to form a conical tapered slit 28 from the circumferential recess 26 toward the lip-like spray hole 24. This counterface 28*a* may be formed in the tip cap 19. Also the slit 28 may be formed by shaping the tip cap 19 as shown in FIG. 3. In any case, the counterface or slit is formed so that the compressed air is blown out along the tapered surface 25 directly toward the spray hole 24 in the tip cap 19. The air cap 22 has provided therein air nozzles 30 with V-recess blow-out hole 29 around the spray hole 24** so that separately adjusted compressed air comes into contact with the blown out paint particles. This construction is the same as that of conventional spray guns in which air is blown as a flat flow correspondingly to the spray flow from the center to form a spray pattern.

In FIG. 2, reference numeral 31 indicates an air amount adjusting valve.

The spray gun of the above-described construction according to the present invention operates as follows.

First, paint entering the paint path 2 as the needle valve 5 goes back is blown out from the blow-out hole 3, mixed inside the atomizing head with compressed air supplied through the air path 7, and sprayed out as a spray flow A by the lip-like spray hole 24 at the front. A pattern forming air flow B blown out from the air nozzles 30 comes into contact with the spray flow A to form a predetermined spray pattern which is directed toward the object to be painted.

Figure 4:
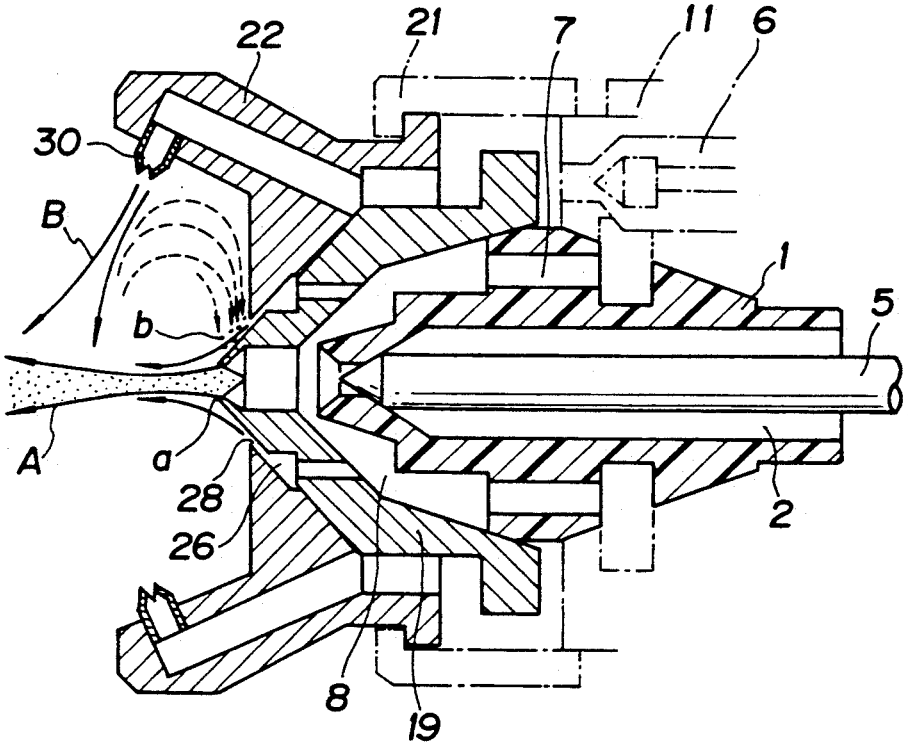
FIG. 4 is an explanatory drawing for showing the spray conditions.
Figure 5:
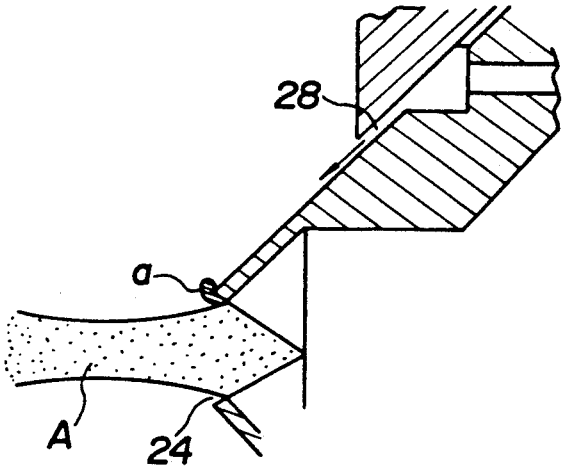
FIG. 5 is an explanatory drawing showing the deflection of the paint.
Figure 6A:
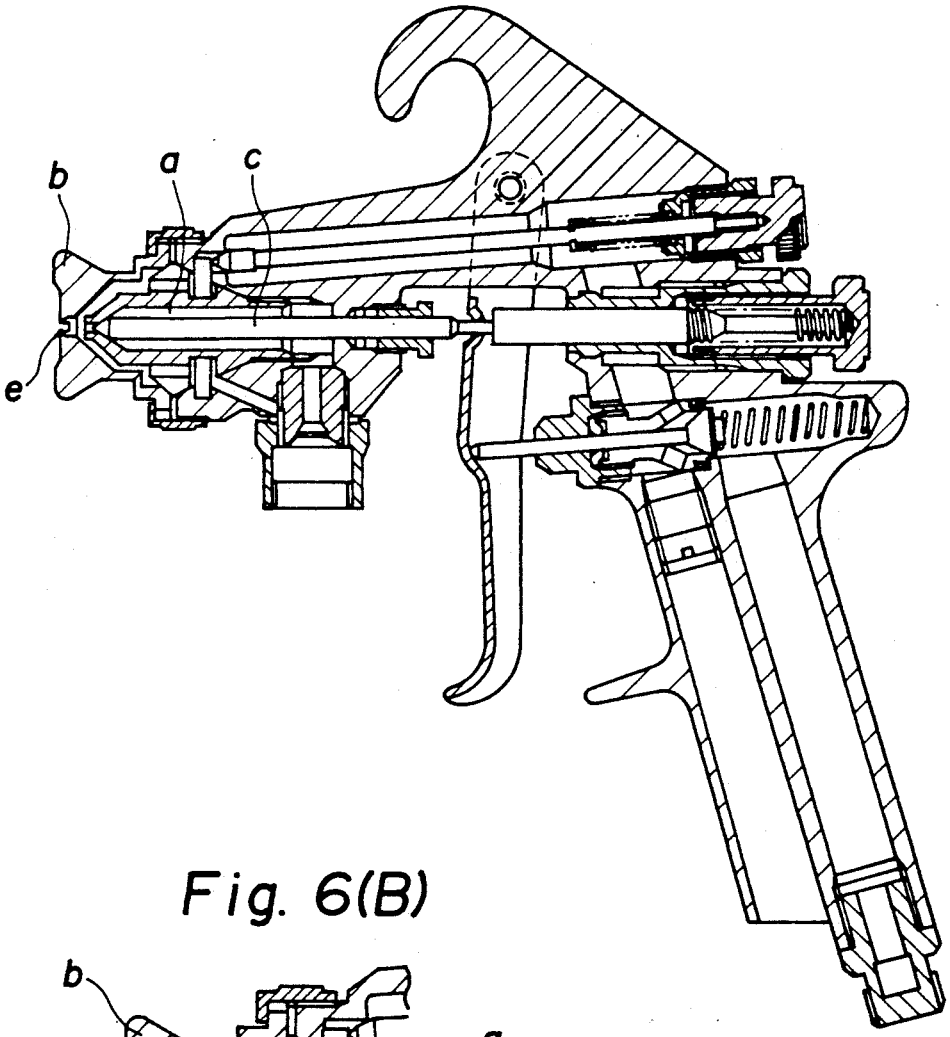
FIGS. 6(A) and 6(B) are a sectional view of a conventional spray gun and a sectional view, enlarged in scale, of the atomizing head thereof.
Figure 6B:
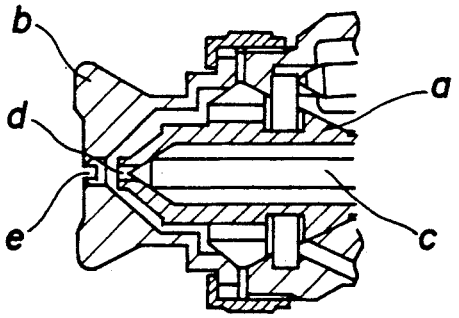

The paint sprayed out from the spray hole 24 will form at the aperture shown in FIG. 4 a mass deflected up as indicated at a in FIG. 5. Since the compressed air is blown along the conical tapered surface 25 on the outside surface of the spray hole 24 through the slit 28 from the circumferential recess 26, the deflected paint mass a is blown back. Also, some of the paint particles in the spray flow A is blown back as indicated at b in FIG. 3; however, it is blown away by compressed air from the slit 28, thus preventing it from adhering.

EFFECT OF THE INVENTION

The premixing-type spray gun according to the present invention has at the central hole of the atomizing head disposed in the spray gun body a conical inner surface, V-shaped recess, lip-like opening and diverging surface. Thus, it is possible with a low pressure of 1 $kgf/cm^2$ to obtain a spraying performance similar to that obtained with a pressure of about 3 to 4 $kgf/cm^2$ in non-premixing-type spray guns, which would be impossible with the conventional premixing spraying. Therefore, a general-use spray coating is possible with atomizing under low pressure, thereby effectively solving problems such as undesirable paint scattering, environmental destruction, etc. Further, the spray gun according to the present invention has provided on the outer conical surface of the tip cap a slit through which compressed air is blown out so as to blow compressed air along the tapered surface, thereby preventing paint adhesion around the outlet of the spray hole and the opening. Namely, spraying can always be done in a desired condition. Also, a poor finish of the spray-painted surface can be avoided and paint adhesion to the surface of the object can be obtained due to stable spraying, so the quality of the spray-painting can be considerably improved. Since the compressed air is blown in a circular air flow enclosing the spray flow, paint scattering can be prevented. Furthermore, the present invention can be used in a premixing/non-premixing type spray gun. This application will be effective to prevent adhesion of sprayed articles to the outer circumference of the spray hole due to disturbance of the sprayed particles by the external colliding flow and involution in the latter.

What is claimed is:

1. A premixing type paint spray gun, comprising:

a paint nozzle having a blow-out hole at the discharge end with an outwardly diverging conical outer end portion;

means for supplying only paint to said paint nozzle under pressure;

an air cap over the discharge end of said paint nozzle and having a spray opening herein in spaced opposed relationship to said blow-out hole; and means for supplying compressed air to the space between said blow-out hole and said spray opening for mixing with paint discharged from said blow-out hole;

said air cap having on the side toward said paint nozzle a cylindrical recess having said spray opening at the inner end thereof and having a shape around said spray opening defining a recess surface tapering inwardly toward said spray opening, and said air cap further having on said side toward said paint nozzle a conical outwardly diverging surface extending toward and past said blow-out hole from an outer end of said recess, said outwardly diverging conical outer end portion of said blow-out hole having a diameter at an outermost end which is slightly greater than a diameter of said cylindrical recess, and said air cap having on the side away from said paint nozzle a tapered surface substantially parallel to and defining with said recess surface an annular edge around said spray opening, said annular edge having a wider portion at the outermost portion of said tapered surface and becoming narrower in a direction toward said paint nozzle for forming said spray opening into a mouth-like opening.

2. A paint spray gun as claimed in claim 1 in which said recess surface is a conical surface.

3. A paint spray gun as claimed in claim 1 in which said spray opening has a V-shape in longitudinal section.

4. A paint spray gun as claimed in claim 1 in which the tapered surface on said air cap on the side away form said paint nozzle is conical, and said spray gun further having an annular discharge opening around said conical tapered surface spaced outwardly from said spray opening and directed along said conical tapered surface, and means for supplying compressed air to said annular discharge opening for directing an annular air stream along said conical tapered surface onto the mixture of paint and compressed air being discharged through said spray opening.

5. A paint spray gun as claimed in claim 1 in which said paint nozzle has a central longitudinal bore leading to said blow-out hole, said blow-out hole having a valve seat there around facing into said bore, and a needle valve movable longitudinal in said bore and engaging and disengaging from said valve seat for opening and closing said blow-out hole, said blow-out hole diverging outwardly in the direction of said air cap, and said air cap having the side toward said paint nozzle spaced from said paint nozzle to define an annular compressed air passage between said nozzle and said air cap for delivering the compressed air to the space between said blow-out hole and said spray opening, whereby paint discharged from said blow-out hole extends in a divergent spray and is acted on by the compressed air flowing through said annular compressed air passage to be atomized and to be carried into said recess in the side of said air cap toward said paint nozzle and outwardly through said spray opening.

* * * * *